United States Patent [19]

Lo

[11] Patent Number: 4,917,376

[45] Date of Patent: Apr. 17, 1990

[54] EXERCISE BICYCLE FOR EXERCISING ARMS AND LEGS

[76] Inventor: Peter K. Lo, P.O. Box 13-124, Taipei, Taiwan

[21] Appl. No.: 343,593

[22] Filed: Apr. 26, 1989

Related U.S. Application Data

[63] Continuation-in-part of Ser. No. 298,692, Jan. 19, 1989, which is a continuation-in-part of Ser. No. 192,166, May 10, 1988, Pat. No. 4,824,102.

[51] Int. Cl.[4] ..... A63B 21/00

[52] U.S. Cl. ..... 272/73; 74/48

[58] Field of Search ..... 272/73, 71, 72, 97, 272/116, 131, 132; 128/25 R; 74/47, 48, 571, 49, 50, 665 GE

[56] References Cited

U.S. PATENT DOCUMENTS

| | | | |
|---|---|---|---|
| 254,082 | 2/1882 | Wiard | 74/47 |
| 326,247 | 9/1885 | Root | 272/73 X |
| 4,188,030 | 2/1980 | Hooper | 272/73 |
| 4,657,244 | 4/1987 | Ross | 272/73 |
| 4,705,269 | 11/1987 | De Boer | 272/73 |
| 4,712,790 | 12/1987 | Szymski | 272/73 |

*Primary Examiner*—Stephen R. Crow

[57] ABSTRACT

An exercise bicycle includes a frame, a crank shaft journalled on the rear portion of the frame, and a wheel axle journalled on the front portion of the frame. Two crank arms are secured to two ends of the crank shaft and carry two pedals. Two swing wheels are secured to two ends of the wheel axle and carry two crank pins on which two sheaves are sleeved rotatably. Two swing levers are mounted pivotally on the front portion of the frame at the lower ends thereof and have lengthwise extending slide slots in which the sheaves are received slidably. A rear driving pulley and a rear driven pulley are sleeved rigidly on a sleeve which is sleeved rotatably on the crank shaft. A mechanism is provided between the crank shaft and the sleeve so as to interlock them when the pedals rotate in a predetermined direction. A front driving pulley is sleeved rigidly on the wheel axle. A front driven pulley and a wheel are sleeved rigidly on a wheel hub which is sleeved rotatably on the wheel axle. The front and rear driven pulleys are rotated by the rear and front driving pulleys through belts. The swinging movement of the swing levers and/or the rotation of the pedals can be converted into the rotation of the wheel.

1 Claim, 4 Drawing Sheets

EXERCISE BICYCLE FOR EXERCISING ARMS AND LEGS

CROSS-REFERENCE OF RELATED APPLICATION

This invention is a continuation-in-part of Application Serial No. 07/298,692 filed on Jan. 19, 1989, which is a continuation-in-part of application Ser. No. 07/192,166 filed May 10, 1988 now Pat. No. 4,824,102.

BACKGROUND OF THE INVENTION

This invention relates to an exercise bicycle, more particularly to one which has a suspended wheel, the suspended wheel being indirectly rotatable by hands and/or feet.

Although the exercise bicycle of the parent application, i.e. Application No. 07/298,692, can effectively exercise the arms and legs of the user, it has a complicated structure consisting of an intermediate driven shaft assembly which can be activated by a hand driven crank shaft and/or a foot driven crank shaft. This drive shaft assembly largely increases the manufacturing cost of the bicycle. Furthermore, in most cases, when either the swing levers or the pedals of a conventional exercise bicycle are activated, the others of them are also driven through a transmission such that the user cannot activate only the swing levers or the pedals.

SUMMARY OF THE INVENTION

An object of this invention is to provide a simple exercise bicycle for exercising the arms and legs in which the above-mentioned driven shaft assembly is not provided.

Another object of this invention is to provide an exercise bicycle in which two swing levers and/or two pedals can be activated to rotate a suspended wheel.

According to this invention, an exercise bicycle has a frame assembly which includes a base frame, a wheel frame fixed on the front portion of the base frame, and a seat frame fixed on the rear portion of the base frame. A crank assembly includes a crank shaft journalled on the seat frame, two crank arms respectively secured to two ends of the crank shaft, two pedals secured to the crank arms respectively, a sleeve mounted rotatably on the crank shaft, and clutch means for locking the sleeve on the crank shaft when the crank shaft rotates in a predetermined direction. The sleeve includes a rear driving pulley sleeved rigidly thereon, and a rear driven pulley sleeved rigidly on the sleeve. A wheel axle assembly includes a wheel axle journalled on the wheel frame, a front driving pulley sleeved rigidly on the wheel axle, two swing wheels secured to two ends of the wheel axle at their centers, two crank pins secured eccentrically to the outer surfaces of the swing wheels respectively, and two sheaves sleeved rotatably on the crank pins respectively. A pair of hand operated swing levers are mounted pivotally at their lower ends on the base frame. Each of the levers has a lengthwise extending slide slot formed therethrough in which the sheave is received slidably in such a manner that the sleeve cannot disengage from the slide slot when the swing lever is swung. The swinging movement of the swing levers causes the corresponding swing wheel to rotate in the predetermined direction. A wheel assembly includes a wheel hub sleeved rotatably on the wheel axle, a wheel sleeved rigidly on the wheel hub, and a front driven pulley sleeved rigidly on the wheel hub. A belt assembly includes a first endless belt trained on the front driving pulley and the rear driven pulley, and a second endless belt trained on the rear driving pulley and the front driven pulley.

When the pedals are rotated in the predetermined direction, the crank shaft, sleeve, rear driving pulley, second endless belt, front driven pulley, hub and wheel are in turn rotated in the predetermined direction. When the levers are swung, the swing wheels, front driving pulley, first endless belt, rear driven pulley, sleeve, rear driving pulley, second endless belt, front driven pulley, hub and wheel are in turn rotated in the predetermined direction. When a first torque is applied to the sleeve by rotating the pedals in the predetermined direction, and when a second torque is applied to the sleeve by swinging the levers, the sum of the first and second torques is output from the rear driving pulley.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
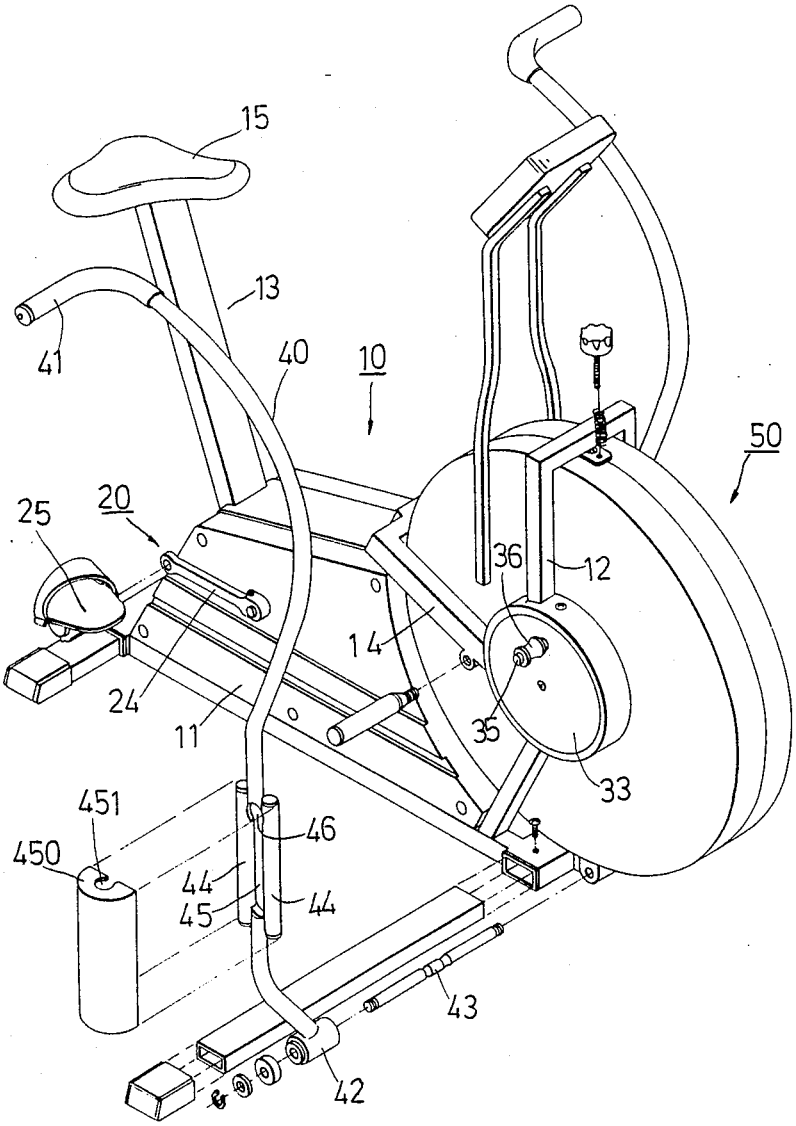
FIG. 1 is an exploded view of an exercise bicycle according to this invention.
Figure 2:
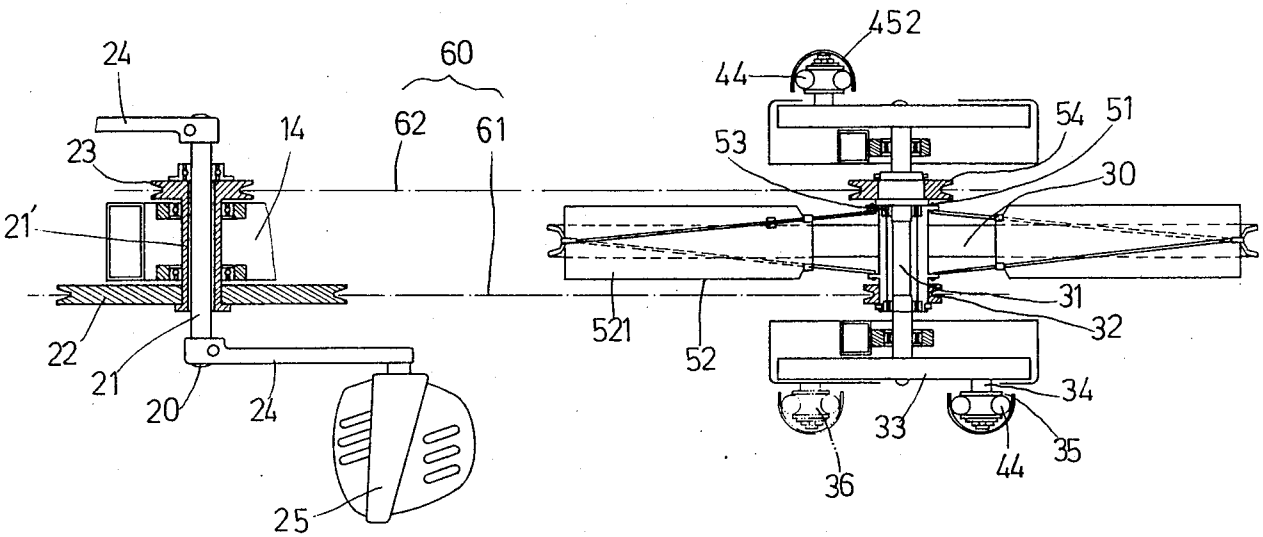
FIG. 2 is a schematic top view showing the exercise bicycle of this invention.

Referring to FIGS. 1 and 2, an exercise bicycle of this invention includes a frame assembly 10, a crank assembly 20, a wheel axle assembly 30, a pair of swing levers 40, a wheel assembly 50 and an endless belt assembly 60.

The frame assembly 10 includes a base frame 11, a wheel frame 12 fixed on the front portion of the base frame 11, a seat frame 13 fixed on the rear portion of the base frame 11. The wheel frame 12 is coupled with the seat frame 13 by a strut unit 14. A saddle 15 is supported on the seat frame 13.

Figure 2A:
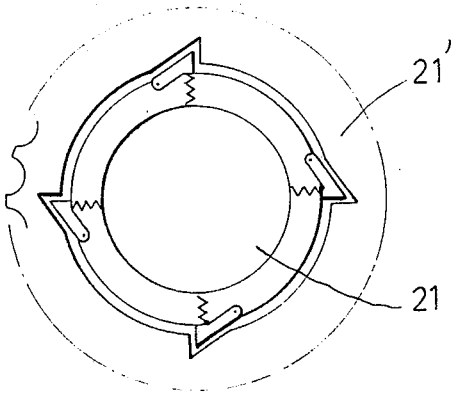
FIG. 2A is a schematic view illustrating how to lock a sleeve on a crank shaft of the exercise in accordance with this invention.

The crank assembly 20 includes a crank shaft 21 journalled on the seat frame 13, a sleeve 21' disposed rotatably on the crank shaft 21, a rear driven pulley 22 sleeved rigidly on the sleeve 21', a rear driving pulley 23 sleeved rigidly on the sleeve 21', two crank arms 24 secured to two ends of the crank shaft 21, and two pedals 25 carried on the crank arms 24. As shown in FIG. 2A, a spring-biased ratchet mechanism is provided between the crank shaft 21 and the sleeve 21' so as to interlock them when the crank shaft 21 is rotated clockwise by stepping on the pedals 25.

The wheel axle assembly 30 includes a wheel axle 31 journalled on the wheel frame 12, a front driving pulley 32 sleeved rigidly on the wheel axle 31, two swing wheels 33 secured to two ends of the wheel axle 31 at their centers, two crank pins 34 secured to the outer surfaces of the swing wheels 33, and two sheaves 35 sleeved rotatably on the crank pins 34.

Each of the swing levers 40 has a grip 41 at the upper end thereof, and a lower end sleeve 42 disposed rotatably on a pivot pin 43 which is fixed on the base frame 11. Two parallel circular tubes 44 are disposed at an intermediate portion of each swing lever 40 so as to define a lengthwise extending slide slot 45 therebetween in which one sheave 35 is received slidably. Each of the slide slots 45 has an enlarged upper end 46 through which the sheave 35 can be inserted so as to enter the lower portion of the slide slot 45. The slide slot 45 is positioned so that the sheave 35 can only slide below the upper end 46 when the swing lever 40 is swung, thereby ensuring that the sheave 35 always slide in the slide slot 45 in use. Two semi-cylindrical hollow shields 450 have retaining notches 451 formed in the ends surface thereof which are engaged with the swing levers 40 so as to cover the circular tubes 44.

Figure 3:
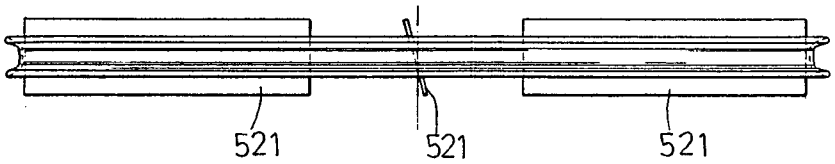
FIG. 3 is a schematic view illustrating the wheel blades of the exercise bicycle according to this invention.

The wheel assembly 50 includes a wheel hub 51, a wheel 52 sleeved rigidly on the wheel hub 51, two bearings 53 disposed between the wheel axle 31 and the wheel hub 51, and a front driven pulley 54 sleeved rigidly on the wheel hub 51. As shown in FIG. 3, the wheel 52 has a plurality of inclined wheel blades 521 so as to create a turbulence in the air, thereby increasing the resistance to the rotation, of the wheel.

The belt assembly 60 includes a first endless belt 61 trained on the front driving pulley 32 and the rear driven pulley 22, and a second endless belt 62 trained on the rear driving pulley 23 and the front driven pulley 54.

When the pedals 25 are rotated clockwise, the crank shaft 21, sleeve 21', rear driving pulley 23, second endless belt 62, front driven pulley 54, wheel hub 51 and wheel 52 are in turn rotated clockwise.

When the swing levers 40 are swung manually to and from in opposite directions, the swing wheels 33, front driving pulley 32, first endless belt6l, rear driven pulley 22, sleeve 21', rear driving pulley 23, second endless belt 62, front driven pulley 54, wheel hub 51 and wheel 52 are in turn rotated clockwise.

When a first torque is applied to the sleeve 21' by rotating the pedals 25 in the predetermined direction, and when a second torque is applied to the sleeve by swinging the swing levers 40, the sum of the first and second torques is output from the rear driving pulley 23.

With this invention thus explained, it is apparent that numerous modifications and variations can be made without departing from the scope and spirit of this invention. It is therefore intended that this invention be limited only as indicated in the appended claims.

I claim:

1. An exercise bicycle comprising:

a frame assembly including a base frame, a wheel frame fixed on a front portion of said base frame, and a seat frame fixed on a rear portion of said base frame;

a crank assembly including a crank shaft journalled on said seat frame, two crank arms respectively secured to two ends of said crank shaft, two pedals secured to said crank arms respectively, a sleeve mounted rotatably on said crank shaft, and clutch means for locking said sleeve on said crank shaft when said crank shaft rotates in a predetermined direction, said sleeve including a rear driving pulley sleeved rigidly thereon, and a rear driven pulley sleeved rigidly on said sleeve;

a wheel axle assembly including a wheel axle journalled on said wheel frame, a front driving pulley sleeved rigidly on said wheel axle, two swing wheels, secured to two ends of said wheel axle at their centers, two crank pins secured eccentrically to outer surfaces of said swing wheels respectively, and two sheaves sleeved rotatably on said crank pins respectively;

a pair of hand operated swing levers mounted pivotally at their lower ends on said base frame, each of said levers having a lengthwise extending slide slot formed therethrough in which said sheave is received slidably in such a manner that said sleeve cannot disengage from said slide slot when said swing lever is swung, swinging movement of said swing levers causing the corresponding said swing wheel to rotate in said predetermined direction;

a wheel assembly including a wheel hub sleeved rotatably on said wheel axle, a wheel sleeved rigidly on said wheel hub, and a front driven pulley sleeved rigidly on said wheel hub; and a belt assembly including a first endless belt trained on said front driving pulley and said rear driven pulley, and a second endless belt trained on said rear driving pulley and said front driven pulley;

whereby, when said pedals are rotated in said predetermined direction, said crank shaft, sleeve, rear driving pulley, second endless belt, front driven pulley, hub and wheel are in turn rotated in said predetermined direction;

when said levers are swung, said swing wheels, front driving pulley, first endless belt, rear driven pulley, sleeve, rear driving pulley, second endless belt, front driven pulley, hub and wheel are in turn rotated in said predetermined direction; and when a first torque is applied to said sleeve by rotating said pedals in said predetermined direction, and when a second torque is applied to said sleeve by swinging said levers, the sum of said first and second torques is output from said rear driving pulley.

* * * * *